US008708092B2

(12) United States Patent
Ito et al.

(10) Patent No.: US 8,708,092 B2
(45) Date of Patent: Apr. 29, 2014

(54) SPEAKER DEVICE

(71) Applicant: Alpine Electronics, Inc., Tokyo (JP)

(72) Inventors: Ryo Ito, Iwaki (JP); Akio Suzuki, Iwaki (JP); Arata Tada, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 13/790,012

(22) Filed: Mar. 8, 2013

(65) Prior Publication Data

US 2013/0284536 A1 Oct. 31, 2013

(30) Foreign Application Priority Data

Apr. 25, 2012 (JP) ..... 2012-099960

(51) Int. Cl.
*H04R 1/02* (2006.01)

(52) U.S. Cl.
USPC ..... 181/156; 181/150; 381/349; 381/389

(58) Field of Classification Search
USPC ..... 181/148, 150, 156, 199; 381/338, 349, 381/386, 389
See application file for complete search history.

(56) References Cited

U.S. PATENT DOCUMENTS 4,509,184 A * 4/1985 Yanagawa ..... 381/308
5,394,478 A * 2/1995 Hathaway et al. ..... 381/86
6,298,943 B1 * 10/2001 Yamada et al. ..... 181/156
6,389,146 B1 5/2002 Croft, III
6,801,633 B2 * 10/2004 Tracy ..... 381/389
7,881,488 B2 * 2/2011 Holmi ..... 381/386
8,045,743 B2 * 10/2011 Aylward et al. ..... 381/388
2004/0003959 A1 * 1/2004 Koizumi et al. ..... 181/150
2009/0185709 A1 * 7/2009 Linhard et al. ..... 381/389
2009/0279733 A1 * 11/2009 Schuster et al. ..... 381/389

FOREIGN PATENT DOCUMENTS

JP 2003-523673 8/2003
JP 2012015703 A * 1/2012
WO WO2011/047435 4/2011

OTHER PUBLICATIONS

English translation of JP 2012-015703 A, accessed Nov. 7, 2013 from JPO website.*

* cited by examiner

*Primary Examiner* — Jeremy Luks
(74) *Attorney, Agent, or Firm* — Brinks Gilson & Lione

(57) ABSTRACT

A speaker device includes a cabinet from which a duct for adjusting the back pressure protrudes, a speaker unit mounted in the cabinet, and an intermediate hollow member including first and second connection portions. A cabin space in which the cabinet is installed is separated from a non-cabin space by a partition wall. If there is a subframe facing the partition wall, the duct cannot be directly connected to the opening formed in the partition wall. The intermediate hollow member is disposed in a small space between the subframe and the partition wall, the second connection portion is connected to the opening, and the duct is connected to the first connection portion.

17 Claims, 3 Drawing Sheets

SPEAKER DEVICE

RELATED APPLICATIONS

The present application claims priority to Japanese Patent Application Number 2012-099960, filed Apr. 25, 2012, the entirety of which is hereby incorporated by reference.

BACKGROUND

1. Field of the Invention

The present invention relates to an electrodynamic speaker device that is installed in a vehicle cabin or the like, the amount of space therein being considerably limited, and in particular, to such a speaker device that is preferably used to reproduce sounds in a low-frequency range.

2. Description of the Related Art

For speaker devices that are preferably used to reproduce sounds in a low-frequency range, such as subwoofers, it is important to adjust the back pressure of a speaker unit mounted in a cabinet. Therefore, some of such speaker devices have a duct for adjusting the back pressure, which is formed so as to protrude from the cabinet. When the speaker unit emits a reproduced sound, air in the cabinet, which vibrates together with the diaphragm, passes through the duct. Therefore, the additional mass of the duct (air resistance in the duct) greatly influences the back pressure of the speaker unit. Accordingly, the back pressure can be adjusted so as to increase the pressure of sounds in an intended low-frequency range by appropriately setting the additional mass of the duct. For example, the back pressure increases when the additional mass is increased by increasing the length of the duct or by decreasing the cross-sectional area of the duct. Conversely, the back pressure decreases when the additional mass is decreased by decreasing the length of the duct or by increasing the cross-sectional area of the duct.

Some existing speaker devices include a cabinet in which a compartment for adjusting the back pressure is additionally formed (see, for example, Japanese Unexamined Patent Application Publication No. 2003-523673 corresponding to U.S. Pat. No. 6,389,146). In such speaker devices, the inside of the cabinet is divided into a plurality of compartments by partition walls, and a compartment in which a speaker unit is mounted and a vacant compartment communicate with each other through a duct formed in a partition wall. Therefore, the back pressure can be adjusted comparatively easily.

When installing a speaker device such as a subwoofer, which includes a cabinet and a duct for adjusting the back pressure protruding from the cabinet, in a vehicle cabin, it is preferable that the duct communicate with the outside of the vehicle cabin. Therefore, in some cases, the duct is connected to an opening formed in a partition wall that separates the inside of the vehicle cabin (acoustic space) from the outside of the vehicle cabin (outer space). Such an opening may be formed beforehand or may be additionally formed. However, because the amount of space in the vehicle cabin is limited, it may be difficult to dispose a cabinet having a duct at a position adjacent to the partition wall. In such a case, the length of the duct in the speaker device may be increased so that the duct can be connected to the opening in the partition wall. However, if the length of the duct is increased, the additional mass of the duct is increased, and the flow of air is excessively restrained when the diaphragm vibrates, and, as a result, the capability of the speaker device to reproduce low-frequency sounds is considerably impaired.

In the case of existing speaker device disclosed in Japanese Unexamined Patent Application Publication No. 2003-523673, in which the back pressure is adjusted by dividing the inside of the cabinet into a plurality of compartments, the size of the cabinet is necessarily increased. Therefore, in general, it is difficult to install such a speaker device in a space, such as a vehicle cabin, the amount of space therein being considerably limited.

SUMMARY

Accordingly, it is an object of the present invention to provide a speaker device whose duct can communicate with an outer space without impairing the capability of the speaker device to reproduce low-frequency sounds even when the duct cannot be directly connected to a partition wall that separates an acoustic space from the outer space.

According to the present invention, a speaker device includes a cabinet; a duct for adjusting the back pressure, the duct protruding from the cabinet; a speaker unit mounted in the cabinet; and an intermediate hollow member. An opening is formed in a partition wall that separates an outer space from an acoustic space in which the cabinet is installed, and the duct communicates with the outer space through the opening. The intermediate hollow member is interposed between the duct and the opening, and the intermediate hollow member includes a first connection portion connected to the duct and a second connection portion connected to the opening. A minimum cross-sectional area of the intermediate hollow member is greater than a cross-sectional area of the duct, and a volume of the intermediate hollow member is greater than a volume of the duct.

The intermediate hollow member having a cross-sectional area and a volume that are larger than those of the duct is interposed between the duct, which protrudes from the cabinet, and the opening formed in the partition wall, which separates the acoustic space from the outer space. By doing so, the inner space of the intermediate hollow member becomes a pseudo-free space for air that flows through the duct as the diaphragm vibrates, and, as a result, the capability of the speaker device to reproduce low-frequency sounds is not likely to be negatively influenced by the addition of the intermediate hollow member. Accordingly, even if the position for installing the speaker device in the acoustic space is limited due to insufficiency in space and it is difficult to dispose the cabinet having the duct in a space adjacent to the partition wall, by disposing the intermediate hollow member in the space adjacent to the partition wall, the speaker device can be used in a state in which the cabinet having the duct is disposed in another larger space.

It is preferable that the speaker device satisfy the expression $(B/A) \geq (4/3)$, where A is the cross-sectional area of the duct and B is the minimum cross-sectional area of the intermediate hollow member. In this case, the degree to which the capability of the speaker device to reproduce low-frequency sounds is impaired by addition of the intermediate hollow member is at a practically negligible level.

It is preferable that the cabinet be installed in a cabin space of an automobile, and the duct communicate with a non-cabin space of the automobile through the intermediate hollow member. In this case, the speaker device is configured so that the duct can easily communicate with the non-cabin space through the opening (such as a vent hole), which has been already formed in the partition wall. As a result, the speaker device can be used as a car subwoofer that can be retrofitted into a wide variety of vehicles.

In the speaker device according to the present invention, the intermediate hollow member having a cross-sectional area and a volume that are larger than those of the duct is interposed between the duct, which protrudes from the cabinet, and the opening formed in the partition wall, which separates the acoustic space from the outer space. Therefore, even if the position for installing the speaker device in the acoustic space is limited due to insufficiency in space and it is difficult to place the cabinet having the duct in a space adjacent to the partition wall, by disposing the intermediate hollow member in the space adjacent to the partition wall, the speaker device can be used in a state in which the cabinet having the duct is disposed in another larger space.

DETAILED DESCRIPTION OF THE PREFERRED EMBODIMENTS

Figure 1:
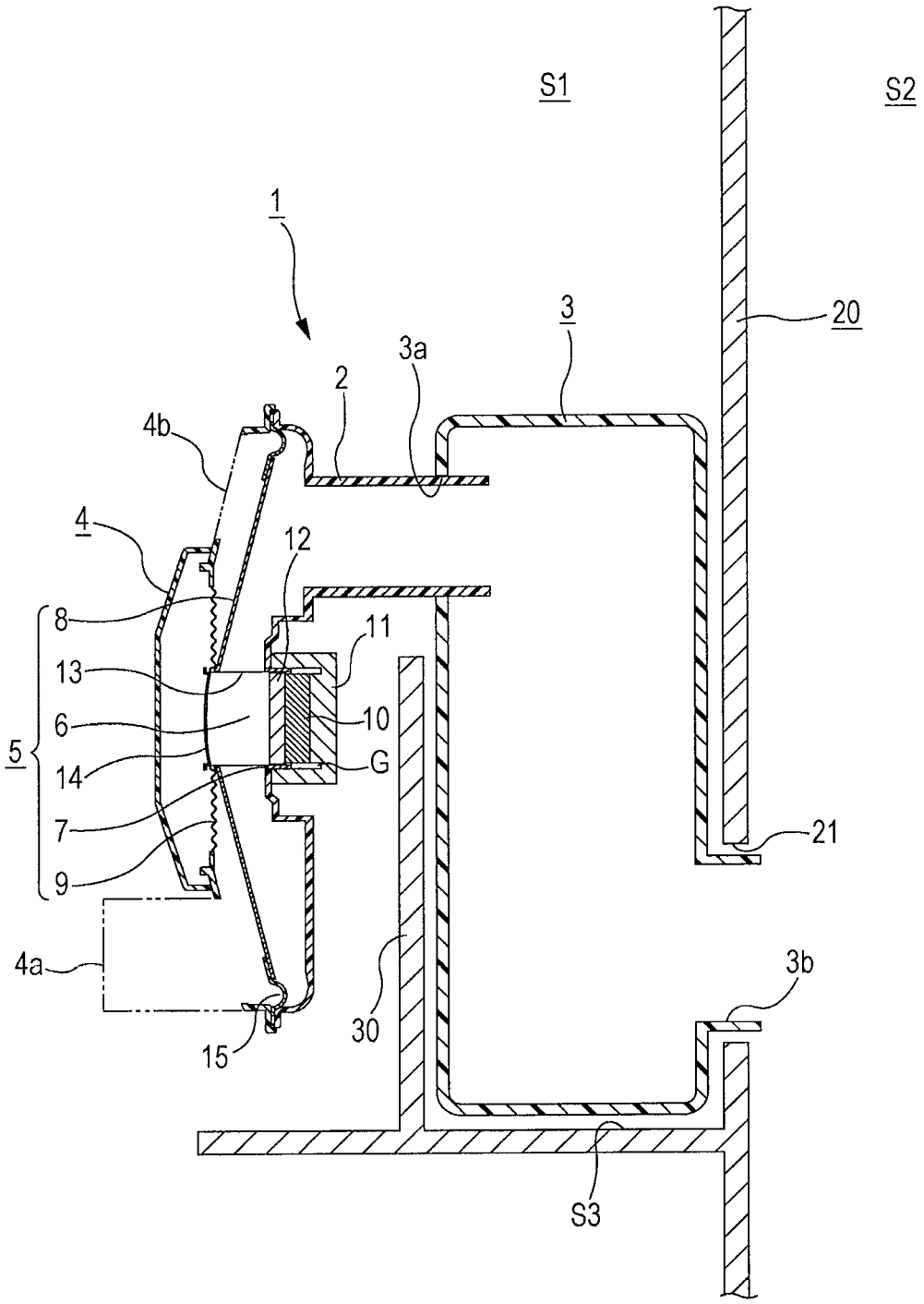
FIG. 1 is a sectional view of a speaker device according to an exemplary embodiment of the present invention installed in a vehicle cabin.
Figure 2:
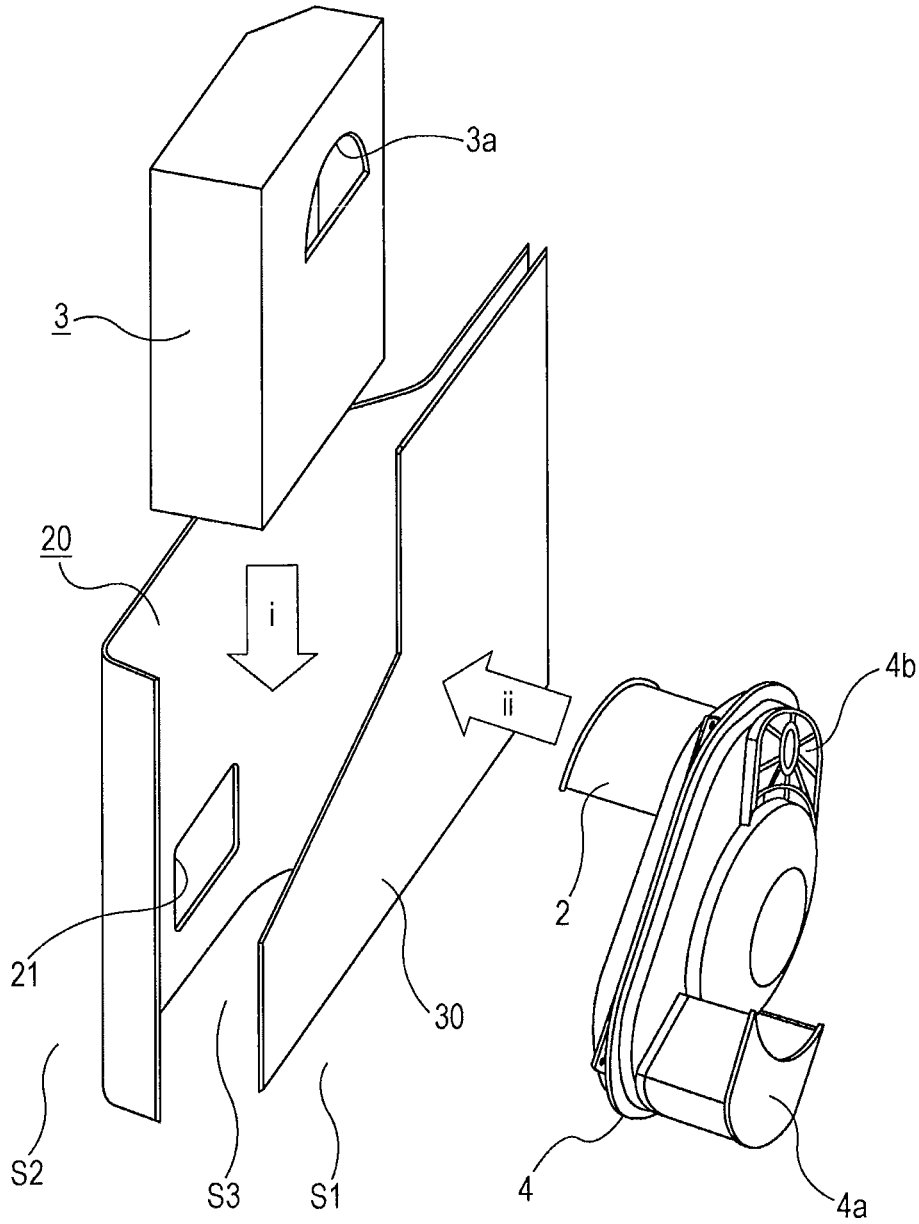
FIG. 2 illustrates the process of installing the speaker device.
Figure 3:
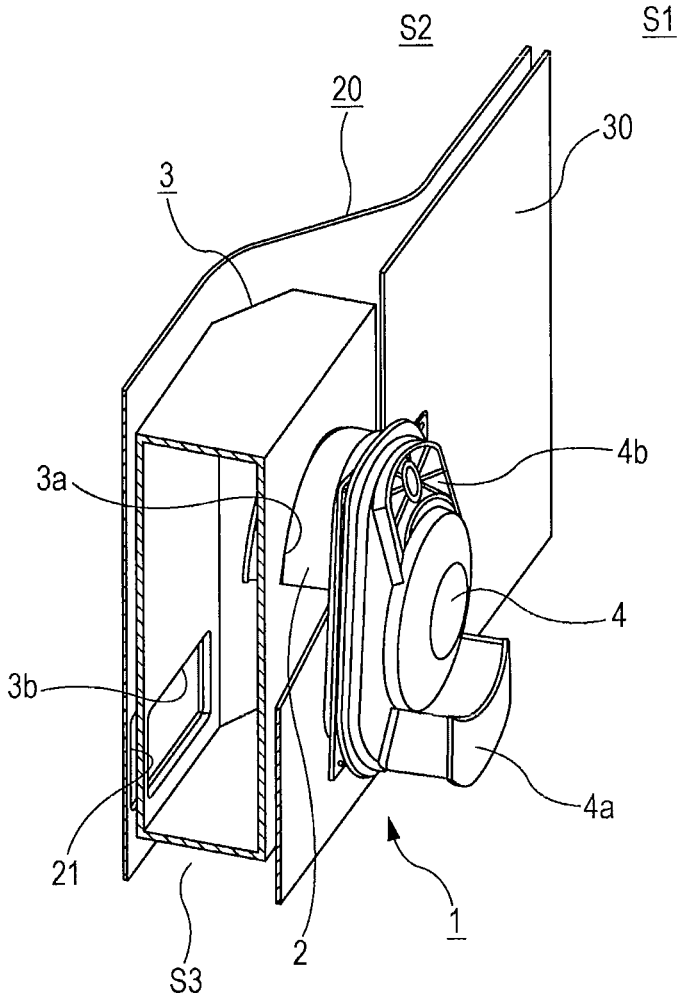
FIG. 3 illustrates the speaker device that has been installed.

Hereinafter, an exemplary embodiment of the present invention will be described with reference to the drawings. As illustrated in FIGS. 1 to 3, a speaker device 1 according to an exemplary embodiment of the present invention is a subwoofer installed in a cabin space S1 of an automobile. The speaker device 1 includes an intermediate hollow member 3, through which a duct 2 for adjusting the back pressure communicates with a non-cabin space S2 such as a trunk compartment. That is, the speaker device 1 includes a cabinet 4, the duct 2 protruding from the back side of the cabinet 4, a speaker unit 5 mounted in the cabinet 4, and the intermediate hollow member 3 connected to the duct 2. The intermediate hollow member 3 can be attached to and removed from the duct 2.

The cabin space S1 and the non-cabin space S2 are separated from each other by a partition wall 20, which is a part of a vehicle body frame. In the present exemplary embodiment, the speaker device 1 is installed at such a position that the duct 2 can communicate with the non-cabin space S2 through an opening 21 that has been already formed in the partition wall 20. For example, a vent hole or the like, which has been already formed, may be preferably used as the opening 21. If there is no appropriate opening that has been already formed, an opening may be additionally formed and used as the opening 21. However, a subframe 30 facing the opening 21 extends near the partition wall 20 in the cabin space S1. There is only a narrow space S3 between the subframe 30 and the partition wall 20, and therefore the cabinet 4 having the duct 2 cannot be disposed in the narrow space S3. That is, the speaker device 1 needs to be installed at such a position that the duct 2 cannot be directly connected to the opening 21. Therefore, as illustrated in FIG. 2, the speaker device 1 is installed at an intended position in the cabin space S1 by disposing the intermediate hollow member 3 in the narrow space S3 (as indicated by arrow i) and then connecting the duct 2 to the intermediate hollow member 3 (as indicated by arrow ii).

The structure of the speaker device 1 will be described in detail. The cabinet 4 and the duct 2 for adjusting the back pressure, which protrudes from the back side of the cabinet, are each made of a synthetic resin. The cabinet 4 and the duct 2 are integrated with each other using screws or the like. The duct 2 is a pipe having a substantially semicircular cross-sectional shape. A first sound port 4*a* and a second sound port 4*b*, through which reproduced sound is emitted to a cabin space S1, are formed on the front side of the cabinet 4. In the present exemplary embodiment, the first sound port 4*a* is provided with a duct and is open, and the second sound port 4*b* is provided with a lid and is closed. Therefore, reproduced sound is emitted through only the first sound port 4*a*. Alternatively, the second sound port 4*b* may be provided with a duct and open and the first sound port 4*a* may be provided with a lid and closed, so that reproduced sound may be emitted through only the second sound port 4*b*. As a further alternative, each of the first sound port 4*a* and the second sound port 4*b* may not be provided with a duct, one of the sound ports 4*a* and 4*b* may be open and the other may be closed, or each of the sound ports 4*a* and 4*b* may not be provided with a lid and may be open.

As illustrated in FIG. 1, the speaker unit 5 includes a magnetic circuit 6, a voice coil 7, a diaphragm 8, and a damper 9. The magnetic circuit 6 has a magnetic gap G. The voice coil 7 is disposed in the magnetic gap G and is driven by electromagnetic interaction that occurs when an electric current is applied. The diaphragm 8 is substantially cone-shaped and vibrates together with the voice coil 7. The damper 9 has an annular shape and elastically supports the voice coil 7 and the diaphragm 8. The magnetic circuit 6 includes a magnet 10, an outer yoke 11, and an inner yoke 12, which form a magnetic path. The magnetic circuit 6 is fixed to the cabinet 4. The magnetic gap G is formed between the outer peripheral surface of the inner yoke 12 and a part of the inner peripheral surface of the outer yoke 11 adjacent to an open end of the outer yoke 11. Magnetic flux that passes through the magnetic circuit 6 crosses the magnetic gap G. The voice coil 7 is wound around a bobbin 13 having a cylindrical shape. An electrical audio signal can be applied to the voice coil 7 through a lead wire (not shown). An inner peripheral portion of the diaphragm 8 and an inner peripheral portion of the damper 9 are bonded to an end of the bobbin 13 (an end away from the magnetic gap G). The end of the bobbin 13 is closed by a dustproof cap 14. The diaphragm 8 is made from a cone paper or the like. An outer peripheral portion of the diaphragm 8 is supported by the cabinet 4 through an edge damper 15. An outer peripheral portion of the damper 9 is also supported by the cabinet 4.

In the present exemplary embodiment, the diaphragm 8 has a shape that widens rightward in FIG. 1. Because the diaphragm 8 is disposed around the magnetic circuit 6, the speaker unit 5 has a small thickness. Alternatively, the diaphragm 8 may be oriented in a direction opposite to that of FIG. 1 (may have a shape that widens leftward in FIG. 1). As a further alternative, the voice coil 7 may be formed so as to have a cylindrical shape and the bobbin 13 may be omitted.

The intermediate hollow member 3 is a hollow box-like member that is made of a synthetic resin and whose external shape is substantially rectangular-parallelepiped-shaped. A first connection portion 3*a* is formed in an upper part of the front surface of the intermediate hollow member 3. An end of the duct 2 can be inserted into and connected to the first connection portion 3*a*. A second connection portion 3*b* is formed in a lower part of the back surface of the intermediate hollow member 3. The second connection portion 3*b* can be inserted into and connected to the opening 21 in the partition wall 20. As can be seen from FIG. 1, the minimum cross-sectional area of the intermediate hollow member 3 is sufficiently larger than the cross-sectional area of the duct 2, and the volume of the intermediate hollow member 3 is sufficiently larger than that of the duct 2. The cross-sectional area of the opening 21 in the partition wall 20 is slightly larger than that of the duct 2. However, the cross-sectional areas of the opening 21 and the duct 2 may be substantially the same as each other.

In the speaker device 1 having the structure described above, when an electrical audio signal is applied to the voice coil 7 disposed in the magnetic gap G, the voice coil 7 is moved leftward and rightward in FIG. 1 due to known electromagnetic interaction, and air in the cabinet 4 is vibrated by the diaphragm 8 that moves together with the voice coil 7, and, as a result, reproduced sound is emitted to the cabin space S1 through the first sound port 4*a*. At this time, although air on the back side of the diaphragm 8 also vibrates in the cabinet 4, the back pressure does not increase excessively when the diaphragm 8 vibrates, because the space on the back side of the diaphragm 8 communicates with the intermediate hollow member 3 having a large volume through the duct 2, and the intermediate hollow member 3 communicates with the non-cabin space S2 through the opening 21. Therefore, the speaker device 1 can be used as a subwoofer having a high sound pressure in the low-frequency range of 30 to 100 Hz.

As heretofore described, the speaker device 1 according to the present exemplary embodiment includes the intermediate hollow member 3, which can be attached to and removed from the duct 2 for adjusting the back pressure. Therefore, even if the position for installing the speaker device 1 in the cabin space S1 is limited due to insufficiency in space, the installation space can be flexibly selected by attaching the intermediate hollow member 3 to the duct 2. That is, the speaker device 1 can be used in a state in which the intermediate hollow member 3 having a cross-sectional area and a volume that are sufficiently larger than those of the duct 2 is interposed between the duct 2, which protrudes from the cabinet 4, and the opening 21 in the partition wall 20, which separates the cabin space (acoustic space) S1 from the non-cabin space (outer space) S2. Therefore, even if it is difficult to place the cabinet 4 having the duct in a space adjacent to the partition wall 20, by disposing the intermediate hollow member 3 in the space adjacent to the partition wall 20, the speaker device 1 can be used in a state in which the cabinet 4 having the duct 2 is disposed in another larger space. If there is sufficient installation space and the duct 2 can be directly connected to the opening 21 in the partition wall 20, the speaker device 1 may be installed without using the intermediate hollow member 3. Accordingly, the speaker device 1 can be installed in a wide variety of installation spaces.

As illustrated in FIG. 1, when the speaker device 1 including the intermediate hollow member 3 is installed in the cabin space S 1, the inner space of the intermediate hollow member 3 becomes a pseudo-free space for air that flows through the duct 2 as the diaphragm 8 vibrates. Therefore, the capability of the speaker device 1 to reproduce low-frequency sounds is not likely to be negatively influenced by addition of the intermediate hollow member 3. That is, the additional mass of the intermediate hollow member 3 is sufficiently smaller than the additional mass of the duct 2, which has been set beforehand. Therefore, the capability of the speaker device 1 to reproduce low-frequency sounds is only negligibly changed by addition of the intermediate hollow member 3. Accordingly, the speaker device 1 can be preferably used as a car subwoofer that can be retrofitted into a wide variety of installation spaces.

The inventors found by experiments that the degree to which the capability of the speaker device 1 to reproduce low-frequency sounds is impaired by addition of the intermediate hollow member 3 is at a practically negligible level when the expression $(B/A) \geq (4/3)$ is satisfied, where A is the cross-sectional area of the duct 2 and B is the minimum cross-sectional area of the intermediate hollow member 3.

In the exemplary embodiment described above, the speaker device 1 is a subwoofer installed in a vehicle cabin. However, a speaker device according to the present invention is not limited to a car subwoofer. The present invention can be applied to any other speaker device whose cabinet is disposed in an acoustic space and whose duct for adjusting the back pressure communicates with an outer space.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker device comprising:

a cabinet;

a duct for adjusting the back pressure, the duct protruding from the cabinet;

a speaker unit mounted in the cabinet; and an intermediate hollow member, wherein an opening is formed in a partition wall that separates an outer space from an acoustic space in which the cabinet is installed, and the duct communicates with the outer space through the opening, wherein the intermediate hollow member is interposed between the duct and the opening, and the intermediate hollow member includes a first connection portion connected to the duct and a second connection portion connected to the opening, wherein the intermediate hollow member is a hollow box-like member and does not include the partition wall, and wherein a minimum cross-sectional area of the intermediate hollow member is greater than a cross-sectional area of the duct, and a volume of the intermediate hollow member is greater than a volume of the duct.

2. The speaker device according to claim 1, wherein the expression $(B/A) \geq (4/3)$ is satisfied, where A is the cross-sectional area of the duct and B is the minimum cross-sectional area of the intermediate hollow member.

3. The speaker device according to claim 1, wherein the cabinet is installed in a cabin space of a vehicle, and the duct communicates with a non-cabin space of the vehicle through the intermediate hollow member.

4. The speaker device according to claim 1, wherein the opening formed in the partition wall is a vent hole.

5. The speaker device according to claim 1, wherein the intermediate hollow member is disposed in a narrow space between the partition wall and a subframe of a vehicle body.

6. The speaker device according to claim 1, wherein an additional mass of the intermediate hollow member is smaller than an additional mass of the duct.

7. A speaker device for installation in an acoustic space of a vehicle, comprising:

a cabinet;

a duct for adjusting the back pressure, the duct protruding from the cabinet;

a sound port through which reproduced sound is emitted to the acoustic space, the sound port being formed in the cabinet;

a speaker unit mounted in the cabinet; and an intermediate hollow member, wherein an opening is formed in a partition wall of the vehicle that separates an outer space of the vehicle from the acoustic space in which the cabinet is installed, and the duct communicates with the outer space through the opening, wherein the intermediate hollow member is interposed between the duct and the opening, and the intermediate hollow member includes a first connection portion connected to the duct and a second connection portion connected to the opening, wherein the intermediate hollow member is a hollow box-like member and does not include the partition wall, and wherein a minimum cross-sectional area of the intermediate hollow member is greater than a cross-sectional area of the duct, and a volume of the intermediate hollow member is greater than a volume of the duct.

8. The speaker device according to claim 7, wherein the expression $(B/A) \geq (4/3)$ is satisfied, where A is the cross-sectional area of the duct and B is the minimum cross-sectional area of the intermediate hollow member.

9. The speaker device according to claim 7, wherein the duct has a substantially semicircular cross-sectional shape.

10. The speaker device according to claim 7, wherein the opening formed in the partition wall is a vent hole.

11. The speaker device according to claim 7, wherein the intermediate hollow member is disposed in a narrow space between the partition wall and a subframe of the vehicle body.

12. The speaker device according to claim 7, wherein an additional mass of the intermediate hollow member is smaller than an additional mass of the duct.

13. A speaker device kit comprising:

a cabinet housing a speaker unit and having a duct protruding from the cabinet for adjusting the back pressure; and an intermediate hollow member including a first connection portion configured to connect to the duct and a second connection portion configured to connect to an opening formed in a partition wall that separates an outer space from an acoustic space in which the cabinet is installed;

wherein the intermediate hollow member is a hollow box-like member and does not include the partition wall;

wherein a minimum cross-sectional area of the intermediate hollow member is greater than a cross-sectional area of the duct, and a volume of the intermediate hollow member is greater than a volume of the duct wherein the cabinet is installed in a cabin space of a vehicle, and the duct communicates with a non-cabin space of the vehicle through the intermediate hollow member.

14. The speaker device kit according to claim 13, wherein the expression $(B/A) \geq (4/3)$ is satisfied, where A is the cross-sectional area of the duct and B is the minimum cross-sectional area of the intermediate hollow member.

15. The speaker device kit according to claim 13, wherein the opening formed in the partition wall is a vent hole.

16. The speaker device kit according to claim 13, wherein the intermediate hollow member is disposed in a narrow space between the partition wall and a subframe of a vehicle body.

17. The speaker device kit according to claim 13, wherein an additional mass of the intermediate hollow member is smaller than an additional mass of the duct.

* * * * *